US007731476B2

(12) United States Patent
Ganelin et al.

(10) Patent No.: US 7,731,476 B2
(45) Date of Patent: Jun. 8, 2010

(54) METHOD AND DEVICE FOR REDUCING AXIAL THRUST AND RADIAL OSCILLATIONS AND ROTARY MACHINES USING SAME

(75) Inventors: Boris Y Ganelin, Brooklyn, NY (US); Michael W Kenworthy, New York, NY (US)

(73) Assignee: Technology Commercialization Corp., Chester, VT (US)

( * ) Notice: Subject to any disclaimer, the term of this patent is extended or adjusted under 35 U.S.C. 154(b) by 741 days.

(21) Appl. No.: 11/668,904

(22) Filed: Jan. 30, 2007

(65) Prior Publication Data

US 2008/0181762 A1 Jul. 31, 2008

(51) Int. Cl.
*F01D 25/16* (2006.01)

(52) U.S. Cl. ..... 415/104; 415/170.1; 415/229; 415/199.5; 416/186 R

(58) Field of Classification Search ..... 415/229, 415/104, 106, 112, 170.1, 206, 211.2, 199.5; 416/186 R, 198 A, 198 R, 203
See application file for complete search history.

(56) References Cited

U.S. PATENT DOCUMENTS 3,663,117 A * 5/1972 Warren ..... 415/116
4,243,274 A 1/1981 Greene
4,402,515 A 9/1983 Malott
5,106,262 A * 4/1992 Oklejas et al. ..... 415/171.1
5,248,239 A 9/1993 Andrews
5,492,310 A 2/1996 Bungart
5,605,434 A * 2/1997 Haag et al. ..... 415/106
5,704,717 A 1/1998 Cochimin
6,129,507 A 10/2000 Ganelin

OTHER PUBLICATIONS

Bently, The Death of Whirl and Whip, Orbit, First Quarter Issue for 2001, pp. 42-47.
Bently, Rotor Dynamics of Centrifugal Compressors in Rotating Stall, Orbit, Second quarter issue for 2001, pp. 40-50.

* cited by examiner

*Primary Examiner*—Ninh H Nguyen
(74) *Attorney, Agent, or Firm*—Boris Leschinsky

(57) ABSTRACT

A method and apparatus to reduce the axial thrust in rotary machines such as compressors, centrifugal pumps, turbines, etc. includes providing additional peripheral restrictive means (7) attached at the peripheral portion of the disk forming the subdividing means (4) on the side facing the rotating rotor (2). An additional ring element at the periphery of the subdividing means forms additional radial (11) and axial restrictive means (15). Such peripheral restrictive means (7, 11 and 15) function as sealing dams, which combined with the outward flow induced by the rotating impeller, form self-pressurizing hydrodynamic bearings in the axial and radial planes, improving rotordynamic stability. Additionally, a stationary ring element in the center of the cavity forms a seal with the rotor, reducing leakage to suction.

16 Claims, 5 Drawing Sheets

METHOD AND DEVICE FOR REDUCING AXIAL THRUST AND RADIAL OSCILLATIONS AND ROTARY MACHINES USING SAME

BACKGROUND OF THE INVENTION

1. Field of the Invention

The present invention relates to a method and device for reducing or eliminating axial thrust, axial oscillations and radial oscillations of the rotor commonly associated with rotary machines. The term "rotary machines" for the purposes of this description includes centrifugal, axial, turbo- and other pumps, compressors, pneumatic and hydraulic turbines and motors, turbine engines, micro-compressors and micro-pumps, MEMS, jet engines and other similar machines. More specifically, the present invention relates to rotary machines having a stationary subdividing disc (subdividing means) located in the cavity between the rotor and the housing for the purpose of changing the nature of the flow dynamics and the pressure distribution along the outside of the rotor (between the stationary subdividing means and the rotor), and creating a hydrostatic/hydrodynamic self-pressurized axial/radial bearing as a functional unit consisting of two elements, the subdividing means and the rotor.

Advanced design features for rotary machines are proposed in the U.S. Pat. No. 6,129,507 by Boris Ganelin. Such design features are described for the front cavity and can be used in any one or several stages of a centrifugal pump or compressor. Such features can also be employed in the rear cavity of a rotary machine. Also, such design features as described in any one of the Figures below may be used in any combination with those of the other Figures as described. The disc-shaped stationary subdividing means in the front cavity (referred to as "subdividing means" throughout this description) and the rotor front portion are generally shown in the Figures as perpendicular to the rotor axis for convenience of presentation, while a conical (or curved) gap formed therebetween is preferred for additional radial control of rotor. The bearing elements (restrictive means areas, dam areas, and pre-dam areas) are shown as flat surfaces in the Figures but it should be understood that they can also be curved, wavy or have conical surfaces to produce alternative hydrodynamic/aerodynamic effects.

Such design featured described herein can also be used independently for the design of a self-pressurized hydrodynamic or aerodynamic bearing with excellent stiffness and damping characteristics, either for controlling axial thrust and/or for maintaining the precise axial/radial positioning of a rotating shaft.

2. Description of the Prior Art

Rotary machines are used in a variety of industries. Centrifugal compressor and pumps, turbo-, gas, and jet engines and pumps, axial flow pumps and hydraulic motors are just some examples of rotary machines. A typical single- or multi-staged rotary pump or compressor contains a generic rotor surrounded by a stationary shroud or housing. A primary working part of the rotor is sometimes also called an impeller which typically contains an arrangement of vanes, discs or other components forming a pumping element that transmits its kinetic rotational energy to the pumping fluid. The rest of the description below refers to the turning part of the rotary machine as a rotor.

One known feature of practically all rotary machines is the presence of the axial force (also known as axial thrust), which impacts the dynamic performance of the rotor. Depending on the rotational speed, rotor diameter, fluid dynamics, angular gap leakage flows and many other parameters, the axial thrust may reach such significant levels so as to present a challenge to reliability of the rotary machines operation. Excessive axial load is especially harmful for the axial thrust bearings. Failure of the axial thrust bearing can cause general failure of the machine. Expensive procedures of bearing replacement comprise a significant part of the overall maintenance of rotary machines, especially turbojet engines and similar machines in which access to the axial bearings is quite difficult. The need therefore exists for a device that would reduce or better yet make insignificant axial thrust in a rotary machine in order to improve its reliability and extend the time between repair services, which is one of the objects of the present invention.

It is also known in the art of rotary machines that the level of axial thrust forces depends on the wear state of the rotor seals of the machine. As the seals wear out, the annular gap leakage flow increases, which unfavorably changes the pressure in the cavities between the rotor and the shroud of the rotary machine and typically causes an increase in the axial thrust. That in turn causes higher yet axial loads on the axial thrust bearings and may bring about their premature failure.

The challenge of reducing axial thrust has been long recognized by designers of the rotary machines. A variety of concepts have been proposed in the prior art in an attempt to solve this problem. One of the most popular methods of reducing the axial thrust is the use of a balancing disk or drum. It is typically added to the back of the rotor and placed in its own balancing cavity in such a way that one side of the disk is subjected to high fluid pressure in order to compensate for the axial thrust cumulatively developed in all of the prior stages of the machine. Another method for axial thrust compensation is to increase the fluid pressure in the appropriate cavity of the rotary machine to exert higher pressure on the rotor and therefore to compensate for the axial thrust. Examples of such method include creating additional fluid passages to increase pressure in the desired area of the rotary machine. Another simple method to address the problem of axial thrust is the use of so-called swirl brakes, a plurality of stationary ribs, grooves or cavities located along the housing in the cavity adjacent the rotor, designed to increase the pressure in the desired area.

Another yet method of axial thrust reduction is proposed in U.S. Pat. No. 6,129,507 by B. Ganelin, a co-inventor of the present invention, this patent is incorporated herein by reference in its entirety. As described in one embodiment of '507 patent, an annular stationary disc (subdividing means) is placed in the cavity between the rotating rotor and the housing and combined with a system of vanes at the perimeter of the cavity. The effect of such new elements is to completely alter the hydrodynamic nature of the flow regime in such cavity, increasing the pressure therein. This in turn has a beneficial effect of reducing the axial thrust forces generated by the machine.

Without the new elements described in '507 patent, the flow regime in such cavity between the rotor and the shroud is characterized by:

1) a tangential velocity component (same direction as rotor),
2) a radially outward velocity component near the rotating rotor shroud,
3) a radially inward velocity component along the housing wall and
4) leakage flow through the cavity entering through the annular gap at the periphery and exiting through the annular seal (eye seal, or face seal) at the shaft.

The pressure in the cavity is lower near the hub (at lower radius) due to the presence of a tangential velocity component of the flow. That component is directed to the hub as it is needed to feed the outward radial flow layer adjacent the rotor shroud. This also explains why the pressure near the hub declines as leakage flow increases through the cavity with worn eye seals, given the increased volume of fluid that must be transported from the periphery to the hub.

With the new elements (stationary annular subdividing means with peripheral vanes) of the above referenced embodiment of '507 patent, the flow regime in such cavity is transformed as follows:

- only outward flow existing in the annular space between the subdividing means and the rotating rotor,
- only inward flow existing in the annular space between the subdividing means and the shroud wall, and
- the peripheral vanes accepting leakage fluid entering through the perimeter annular gap and fluid centrifuged out by the rotating rotor, redirecting it toward the hub in the annular space between the subdividing means and the shroud wall.

The entering leakage flow (with tangential component) and fluid centrifuged by the rotor is efficiently redirected by the peripheral vanes into radial inward flow in the segregated annular space behind the subdividing means to freely supply the hub area with fluid, and therefore not requiring a low pressure area at the hub to attract such fluid. That in turn results in a greater pressure near the hub and so less axial thrust is generated by the machine. Given such transformation of flow regime in the annular cavity adjacent the rotating rotor, a number of rotor-dynamic benefits are achieved, including a significant reduction in potentially destabilizing turbulence, lower sensitivity of rotor to potentially destabilizing leakage flow, improved rotor-dynamic characteristics of rotor seals, isolation of the rotor from potentially destabilizing downstream pressure variations entering through the peripheral annular gap, etc.

In one embodiment, the '507 patent teaches how to reduce axial thrust using an annular subdividing means with peripheral vanes in the front cavity of a centrifugal compressor or pump, but given larger forces (integral of pressure multiplied by radially exposed surface area of rotor shroud) imposed on the back shroud of the rotor, residual axial thrust directed toward the front is still typically greater than desired. The need exists therefore for a device to further reduce axial thrust, which is simple in design, easy to install, low in cost, does not require monitoring and control devices to work properly, and is effective in its function over a wide range of operating parameters of the rotary machine, which is one of the objects of the present invention.

Centrifugal compressors and pumps utilize a thrust bearing at one end of the rotor shaft to adsorb residual axial thrust acting on the rotor and to determine the axial position of the rotor. Given the varying forces acting on the rotor during operation over its useful life, the variations in the thickness of the lubricating film of the thrust bearing, the potential wear of the thrust bearings and the various potential bending modes of the rotor itself, the axial position of the rotor during operation will vary over the life of the machine. Such variations in axial position of the rotor impact various operating parameters of the pump or compressor, reducing potential machine efficiency and most likely negatively impacting rotor-dynamic stability. Significant efforts are made by engineers to minimize such variations in axial position of the rotor during operation. The need exists therefore for a device to further reduce these variations in axial position of the rotor over the life of said the rotary machine, which is another object of the present invention.

In addition, centrifugal compressors and pumps also utilize radial bearings at both ends of the shaft to support the rotor in the radial direction. Thus, given that the radial and axial forces acting on the rotor are generated mid-span (on impellers and its sealing elements), and such forces are compensated for at a location distant from where they are generated, the need exists for a device to counteract/correct any destabilizing forces near the place where they are generated to reduce the amplitude of radial and axial vibrations of the rotor to therefore improve rotor-dynamic stability, to allow closer tolerance seals, to improve efficiency and to improve reliability of the machine. This is yet another object of the present invention.

As discussed in *Rotor Dynamics of Centrifugal Compressors in Rotating Stall* in Orbit (2001) by Donald E. Bently et. al., most publications relating to high pressure pumps and compressors report two types of rotor vibrational behavior:

- high eccentricity and rotor first natural frequency re-excitation, and
- sub-synchronous forward precession with rotative speed-dependent frequency.

The former is usually referred to as whip-type behavior, and is normally associated with balance pistons, fluid-film bearings, and labyrinth seals. The latter is called whirl-dependent behavior and can be associated either with fluid-film bearings/seals or with rotating stall (appearance of a low sub-synchronous frequency component in the rotor vibrational spectrum). The motion describing the behavior of the rotor when its geometrical center does not coincide with its center of gravity is called whirl. Precession is the other oscillatory type of motion, which is caused by misalignment of the principal axis of inertia of the rotor disk and the axis of the shaft.

Fluid-induced instability can occur whenever a fluid, either liquid or gas, is trapped in a gap between two concentric cylinders, and one is rotating relative to the other. The situation exists when any part of a rotor is completely surrounded by fluid trapped between the rotor and the stator, for example in fully lubricated (360° lubricated) fluid-film bearings, around impellers in pumps, or in seals. Fluid-induced instability typically manifests itself as a large-amplitude, usually sub-synchronous vibration of a rotor, and it can cause rotor-to-stator rubs on seals, bearings, impellers, or other rotor and stator parts. The vibration can also produce large-amplitude alternating stresses in the rotor, creating a fatigue environment that can result in a shaft crack. Fluid-induced instability is a potentially damaging operating condition that must be avoided.

In *The Death of Whirl and Whip, Use of Externally Pressurized Bearings and Seals for Control of Whirl and Whip Instability*, published by the Bently Pressurized Bearing Company, reference is made to an equation to estimate the Threshold of Instability, Ω:

$$\Omega=(1/\lambda)*\sqrt{K/M}$$

where λ is the fluid circumferential velocity ratio (a measure of fluid circulation around the rotor, and is indicative of the damping of the system), K is the rotor system spring stiffness and M is the rotor system mass. As presented, if the rotor speed is less than Ω, then the rotor system will be stable. Thus, Ω is indicative of the maximum anticipated operating speed to ensure stability.

Based on the above equation, the Threshold of Instability can be increased by either increasing λ or decreasing K. The value of λ can be influenced by the geometry of the bearing or seal, the rate of end leakage out of the bearing or seal, the eccentricity ratio in the bearing system or seal, and the presence of any pre- or anti-swirl that may exist in the fluid. Fluid-induced instability originating in fluid-film bearings is commonly controlled by bearing designs that break up circumferential flow. Examples of such bearings include tilting pad, lemon bore, elliptical, and pressure dam bearings. λ can also be controlled by anti-swirl injection of fluid into the offending bearing or seal.

Fluid-induced instability can also be reduced or eliminated by increasing the rotor spring stiffness, K. This effort is complicated by the fact that K actually consists of two springs in series, the shaft spring, KS, and the bearing spring, KB. For these two springs connected in series, the stiffness of the combination is given by the following expression:

$$K = \frac{1}{\left(\frac{1}{K_S} + \frac{1}{K_B}\right)} = \frac{K_B}{\left(1 + \frac{K_B}{K_S}\right)} = \frac{K_S}{\left(1 + \frac{K_S}{K_B}\right)}$$

For any series combination of springs, the stiffness of the combination is always less than the stiffness of the weakest spring. The weak spring controls the combination stiffness. For example, assume that KB is significantly smaller than KS. Thus, KS is much larger than KB, and so the middle equation can be used (KB controls combination stiffness). As KS becomes relatively large, K becomes approximately equal to KB. For this case, the system stiffness, K, can never be higher than KB; in practice it will always be less. A similar argument can be used with the rightmost equation when KB is relatively large compared to KS; the system stiffness will always be lower than KB.

Stiffness of the bearing, KB, is significantly affected by the level of eccentricity of the axis of rotor relative to the axis of the bearing. Assuming that the source of rotor instability is a plain, cylindrical, hydrodynamic bearing, for example an internally pressurized bearing, when the journal is close to the center of the bearing (the eccentricity ratio is small), the bearing stiffness is much lower than the shaft stiffness. In this case, the ratio KB/KS is small, and so the combination stiffness is a little less than KB. In other words, at low eccentricity ratios, the bearing stiffness is the weak stiffness and so it controls the combination stiffness.

On the other hand, when the journal is close to the bearing wall (the eccentricity ratio is near 1), the bearing stiffness is typically much larger than the rotor shaft stiffness. Because of this, the ratio KS/KB is small. Therefore, the rightmost equation above indicates that the combination stiffness is a little less than KS. Thus, at high eccentricity ratios, the shaft stiffness is the weak stiffness, and so it controls the combination stiffness.

Fluid-induced instability begins with the rotor operating relatively close to the center of the bearing. The whirl vibration is usually associated with a rigid body mode of the rotor system. During whirl, the rotor system vibrates at a natural frequency that is controlled by the softer bearing spring stiffness.

Whip is an instability vibration that locks to a more or less constant frequency. The whip vibration is usually associated with a bending mode of the rotor system. In this situation, the journal bearing operates at a high eccentricity ratio, and KB is much larger than KS. So KS is the weakest spring in the system, and it controls the natural frequency of the instability vibration.

To summarize, at low eccentricity ratios, the bearing stiffness controls the rotor system stiffness. Therefore, any changes in bearing stiffness will show up immediately as changes in the overall rotor system spring stiffness, K. On the other hand, at very high eccentricity ratios, the constant shaft stiffness is in control, and the overall rotor system spring stiffness will be approximately independent of changes in bearing stiffness.

The Bently Pressurized Bearing Company suggests using externally pressurized bearings to selectively control bearing stiffness, in an effort to increase rotor combination stiffness. In whirl, the bearing stiffness is the weak stiffness (controlling element) of the system, and so by increasing the externally supplied pressure in the desired bearing (and in the desired radial direction), the bearing stiffness KB increases, and therefore increasing system spring stiffness, K. It is suggested that whirl can be eliminated in this fashion. In whip, the bearing stiffness KB is very high, and the shaft stiffness KS is the weak spring in the system, so increasing bearing stiffness will have no effect on the overall system spring stiffness, K (combination stiffness). Instead, it is suggested to position the Bently externally pressurized bearing mid-span on the rotor to directly increase the stiffness of the shaft, thereby again making the end bearing stiffness the weakest spring (and so the controlling spring), which is the preferred operating mode for stability. The resulting effect is to increase the Threshold of Instability, Ω. A major drawback is that this bearing design is externally pressurized, resulting in higher efficiency losses, added complexity, increased cost and lower reliability.

In another example, U.S. Pat. No. 4,243,274 describes a hydrodynamic bearing capable of transmitting radial, thrust and moment loads between an inner load applying member rotatably connected to the bearing utilizing a pair of cylindrical groups of bearing pads about a longitudinal axis of rotation. The pads have movable face portions with compound curved bearing surfaces symmetrically disposed about and along the longitudinal axis. The curved surfaces are mating with similar curved bearing surfaces on a load applying member. The face portions of the bearing pads are supported so that they are swingable about "swing points" located between the axis of rotation of the bearing and the face portions thereof. The bearing pads are operating under the combined influences of friction and load forces exerted thereagainst by the load applying member, so that through hydrodynamic action wedge-shaped lubricant films are generated between the relatively moving bearing surfaces to maintain the surfaces apart while motion is occurring. While U.S. Pat. No. 4,243,274 teaches a hydrodynamic thrust/journal bearing along with the radial control benefits provided by an angular/conical/curved annular gap, it does not benefit from hydrostatic action and its dimensions do not lend to its application in the rotor side cavity area of rotary machines.

In rotary machines, bearings supporting the rotor shaft in the radial direction are placed near the ends of the shaft, and while it is unusual to position bearings mid-span on the shaft, radial stiffness and damping effects provided by some advanced inter-stage shaft seal designs are viewed as helpful in reducing such radial deflection of the rotor during operation. Minimizing the extent of radial deflection (minimum orbit) of the rotating rotor is a consistent goal of engineers. Minimizing the orbit may enable higher rotational speeds to improve productivity, to reduce potential for damage caused by rotor-dynamic instability, to allow smaller clearance seals, to improve efficiency, to improve reliability, etc. The need exists therefore for a device to further reduce said radial deflection (orbit) of the rotor in order to improve the performance of rotary machines, which is yet another object of the present invention.

In addition to the general use in centrifugal pumps, compressors and other turbo machines, the present invention is particularly useful in rotary machines used for water and air supply, for oil and natural gas recovery, refinement and transport, in chemical and food processing industry, for power plants including nuclear power plants, for turbine engines and particularly jet engines as well as in a number of other applications.

BRIEF DESCRIPTION OF THE DRAWINGS

A more complete appreciation of the subject matter of the present invention and its various advantages can be realized by reference to the following detailed description which reference is made to the accompanying drawings in which.

DETAILED DESCRIPTION OF THE INVENTION

Figure 1:
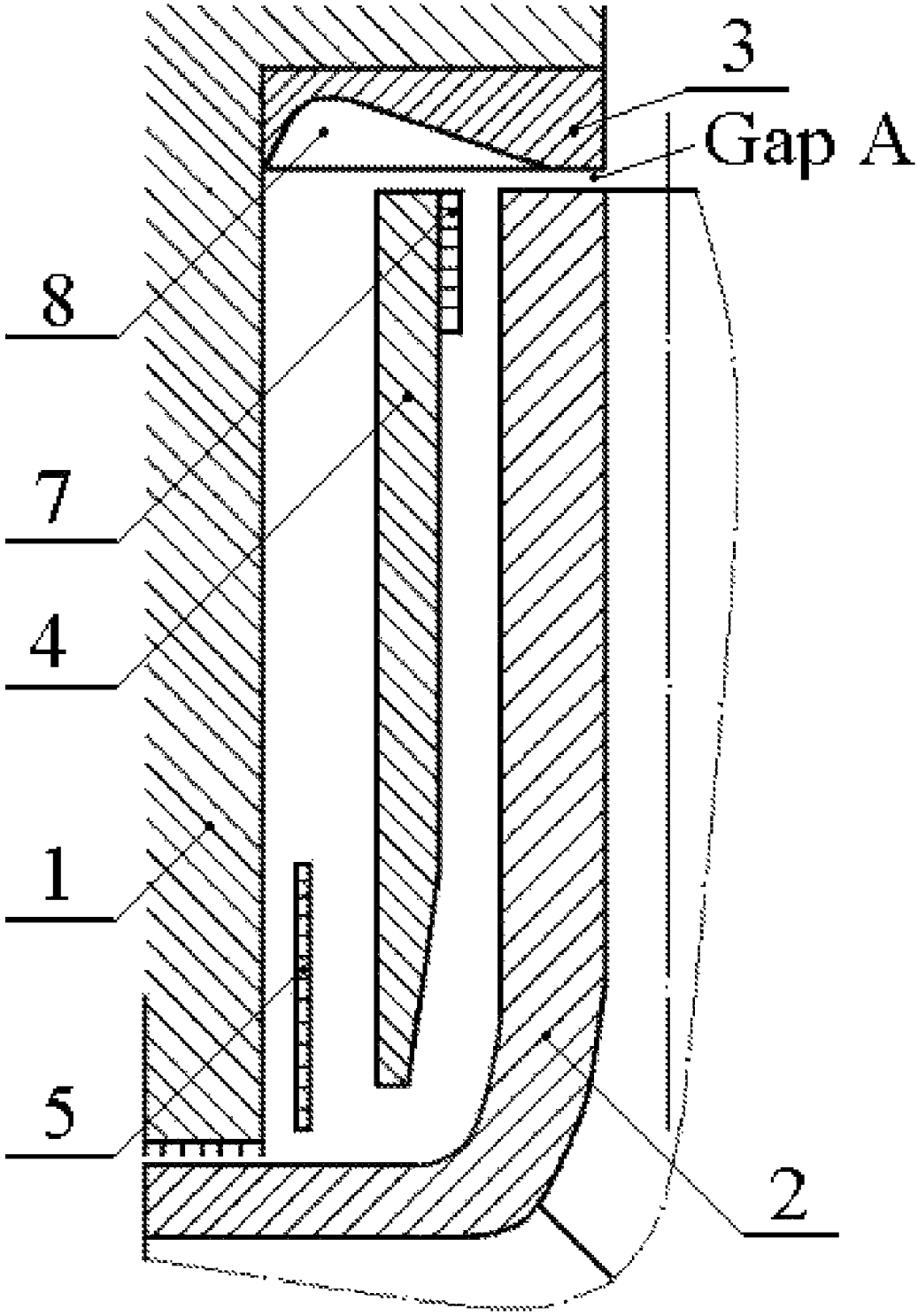
FIG. 1 is a cross-sectional view of a fragment of a rotary machine equipped with a device for reduction of axial thrust according to the first embodiment of the present invention containing an additional annular disc.

A detailed description of the present invention follows with reference to the accompanying drawings in which like elements are indicated by like reference numerals.

FIG. 1 illustrates a fragment of one of the stages of a typical radial rotary machine such as a centrifugal pump that may contain one or more stages. The pumping element is sometimes referred to as the impeller. Although the geometry of the rotor may vary according to the pumping conditions such as in the so-called radial, mixed-flow or axial pumps and compressors, they all have the same basic elements, namely the rotor having a front surface and a rear surface, a housing shroud containing that rotor, and seals minimizing the leaks from the high pressure areas at the outlet of the pump to the low pressure areas at the inlet of the pump. The present invention is illustrated only with references to the radial flow type centrifugal pump or compressor, but it can be easily adapted by those skilled in the art to other types of rotary machines.

Design Features of the First Embodiment of the Invention as Shown on FIG. 1

In FIG. 1, rotating rotor (2) induces outward rotating flow of the adjacent fluid, which then enters the peripheral vane system (8). Such flow, combined with leakage flow through the annular gap at the periphery of rotor (2) (Gap A), having tangential momentum, is redirected by peripheral vanes (8) into radially inward flow directed toward hub between the stator (1) and subdividing means (4). Stator (1) is assumed to be a part of the housing shroud of the rotary machine. Radial ribs (not shown) may be used to attach subdividing means (4) and additional optional radial disc (5) to stator (1) and to further condition flow. The purpose for the optional radial disc (5) is to assist in improving flow conditions (preferably, reverse direction to shaft using anti-rotation vanes, not shown) for leakage flow entering shaft seal.

An important feature shown in FIG. 1 is that subdividing means (4) is designed to separate the flow in the general cavity formed by the interior wall of the housing shroud and the rotor into a first flow and a second flow. The first flow is channeled between the subdividing means (4) and the rotor (2), while the second flow is separated from the first flow by the subdividing means (4) and directed towards the space between the interior wall of the shroud (1) and the subdividing means (4). Importantly, subdividing means (4) is positioned with a small axial distance from the rotating rotor (2) forming a small gap for the first flow to go through. Such small axial distance may be 0.1 to 3 mm, and potentially much less, such as on the order of a distance often found in hydrodynamic bearings (10 to 100 microns, for example). The combination of 1) such small axial gap between the rotating rotor and its stationary opposing face, and 2) the outward radial flow regime of the working fluid provides flow conditions similar to those of hydrodynamic bearings. That in effect forms a self-pressurizing hydrodynamic thrust bearing (stiffness and damping qualities of such bearing increase/improve as such axial gap is reduced).

Importantly, an additional peripheral restrictive means (7) is attached (or formed therewith) at the peripheral portion of the disk forming the subdividing means (4) on the side facing the rotating rotor (2). Such peripheral restrictive means (7) functions as a sealing dam for the self-pressurizing hydrodynamic bearing, producing a localized increase in pressure at the front edge (upstream edge) of restrictive means (7), also producing lift and therefore helping to prevent direct contact with the rotating rotor (2). The axial position of the rotor (2) determines the degree of restriction to outward radial flow via an annular gap imposed by the peripheral restrictive means (7). Axial movement of the rotor in one direction produces a larger gap resulting in less flow restriction and therefore a lower upstream pressure in the gap region (causing less force pushing the opposing axial faces apart). At the same time, axial movement of the rotor in the other direction produces a smaller annular gap resulting in increased flow restriction and higher upstream pressure in the annular gap region (causing more force pushing the opposing axial faces apart). This arrangement therefore results in a self-adjusting system seeking an equilibrium position of the rotor in the axial direction. The restrictive means (7) may alternately be placed on the rotating surface of the rotor as well, given similar peripheral radial placement. More than one (or a series of many) restrictive means (7) may be placed on the subdividing means (4) (or rotating rotor (2)) to increase hydrodynamic lift capacity and stability.

Hydrodynamic thrust bearings are known for their simplicity and excellent stiffness and damping characteristics, allowing for precise axial positioning and high rotational speeds. The restoring forces between the two opposing faces increase as the opposing faces approach, preventing therefore their direct contact. Damping characteristics may be modified by arranging the subdividing means (4) (and correspondingly its opposing rotor face) at an angle greater (or less) than 90° to the shaft axis (conical or knee-shaped front rotor). All design elements used with hydrodynamic bearings are potentially beneficial in improving rotor-dynamic stability for designs of the type described here in FIG. 1.

Other design elements common for hydrodynamic bearings are potentially beneficial for application with the present invention. In the ring area on the surface of the subdividing means (4) adjacent to ring area of restrictive means (7) and having smaller radius, thin radial slots (such as Rayleigh steps), or spiral grooves, wavy surface, etc. generally referred to herein as radial ribs can be cut into the surface or otherwise formed within the subdividing means (4). Alternatively, protruding radial ribs directed towards axis or canted at an angle may be formed such that the outward radial flow is conditioned by these grooves or ribs immediately prior to passing over the restrictive means (7) to improve lift characteristics. The groove depth is preferably about the same as the height of the restrictive means (7), or smaller (except in cryogenic conditions, where it should be larger given the lower fluid viscosity). The radial length of such smaller radius ring area may be increased (extend further toward the hub) to increase film stiffness. Given the same radial placement, such grooves (and ribs) can be located on the opposing face of the rotor (2) instead of only on the subdividing means (4). Such radial ribs as Rayleigh steps, spiral grooves, wavy surface, protruding ribs, etc. may also be formed into the radial face of the restrictive means (7) that is opposite the front rotor (2). The inner radial edge plane of restrictive means (7) may be perpendicular to subdividing means (4), at an angle or contoured to provide more desirable lift characteristics. The restrictive means (7) may preferentially be made using a softer material (to abrade sacrificially) than the opposing rotor.

Additionally, to increase lift in the region near the periphery of the rotating rotor, the gap between the rotating rotor (2) and the subdividing means (4) may converge slightly with increasing radius. Benefits include improved rotor-dynamic stability, improving reliability.

Given a very small gap (<100 microns) between the rotating rotor (2) and the subdividing means (4), and the significant surface area of the rotating rotor, it is possible to utilize more aggressive lift mechanisms (deeper Rayleigh Steps, spiral grooves, wavy surface, etc.) over a greater area of the subdividing means or rotor to produce additional axial thrust forces, further increasing its load capacity as a self-pressurizing hydrodynamic thrust bearing.

When using a semi-rigid material to make the subdividing means, and its close proximity to the rotating rotor, there is a further potential to provide damping to the rotating rotor through the deflection of (and adsorption by) the semi-rigid subdividing means (4) in response to pressure waves (adsorbing wave energy).

Figure 2:
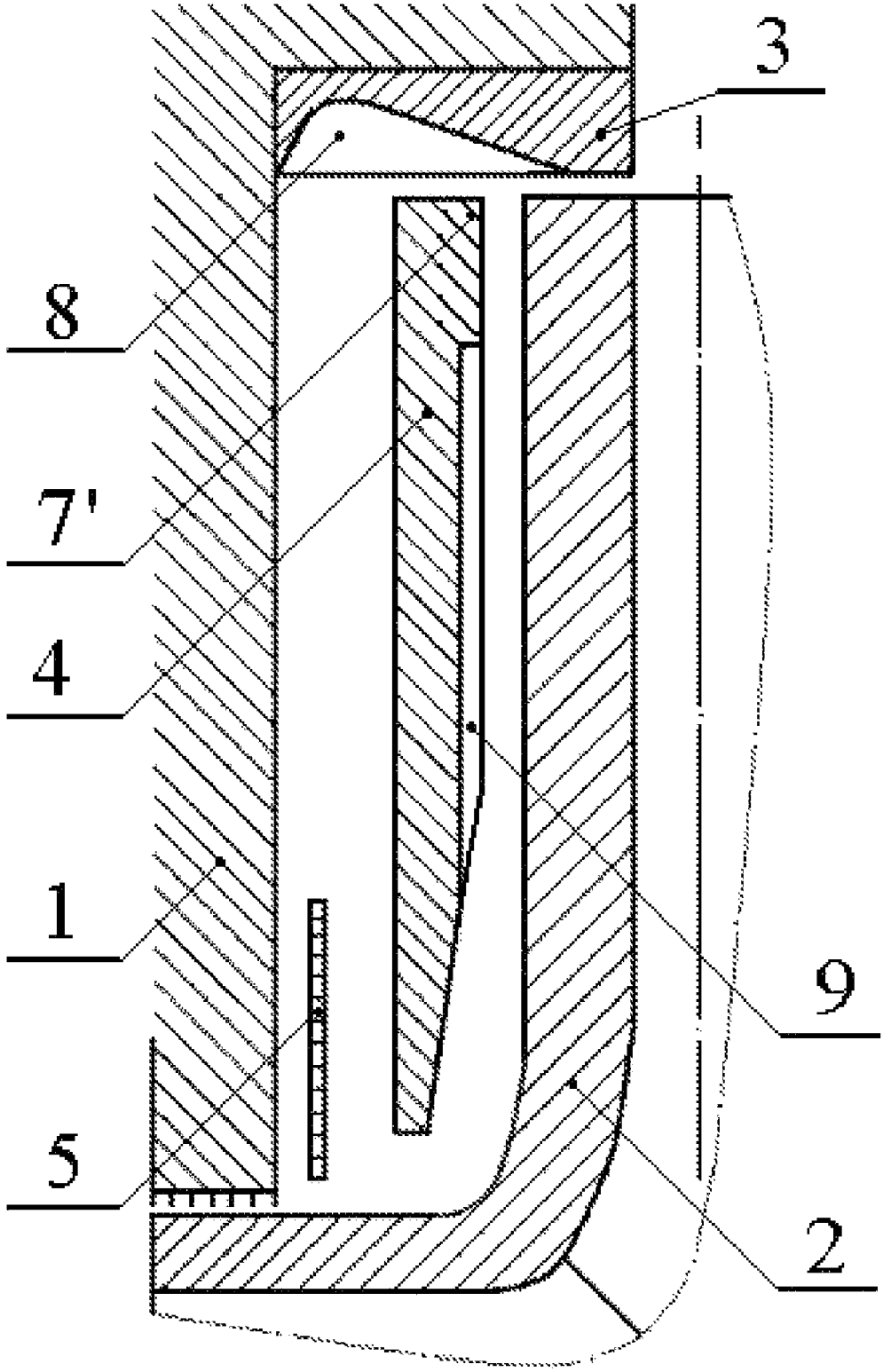
FIG. 2 is a cross-sectional view of a fragment of a rotary machine equipped with a device for reduction of axial thrust according to the second embodiment of the present invention.

Design Features of the Second Embodiment of the Invention as Shown on FIG. 2

Many design elements of FIG. 1 are incorporated into FIG. 2. The primary difference is that raised ring-shaped restrictive means (shown as position 7 in FIG. 1) has been removed, and that spiral grooves (9) (or vanes, wavy surface, Rayleigh steps, etc.) have been cut into the subdividing means (4) on the side facing the rotating rotor. Such spiral grooves (as shown) do not extend all the way to the outer perimeter of the subdividing means (4) therefore forming an outer ring face section (7') (the landing area) that functions as a peripheral restrictive means (such as the dam of hydrodynamic ring seals), where the high pressure produced by the spiral grooves results in lift at the leading edge of restrictive means (7'), providing separation forces between the two opposing faces. Compared to the design in FIG. 1, the design features of FIG. 2 allow for increasing/improving axial stiffness and damping characteristics. The peripheral vanes (8) can be formed as part of a ring section (3) where, for ease of production, such vanes can be manufactured/shaped separately from the casing, and then press fit and welded into the casing.

Figure 3:
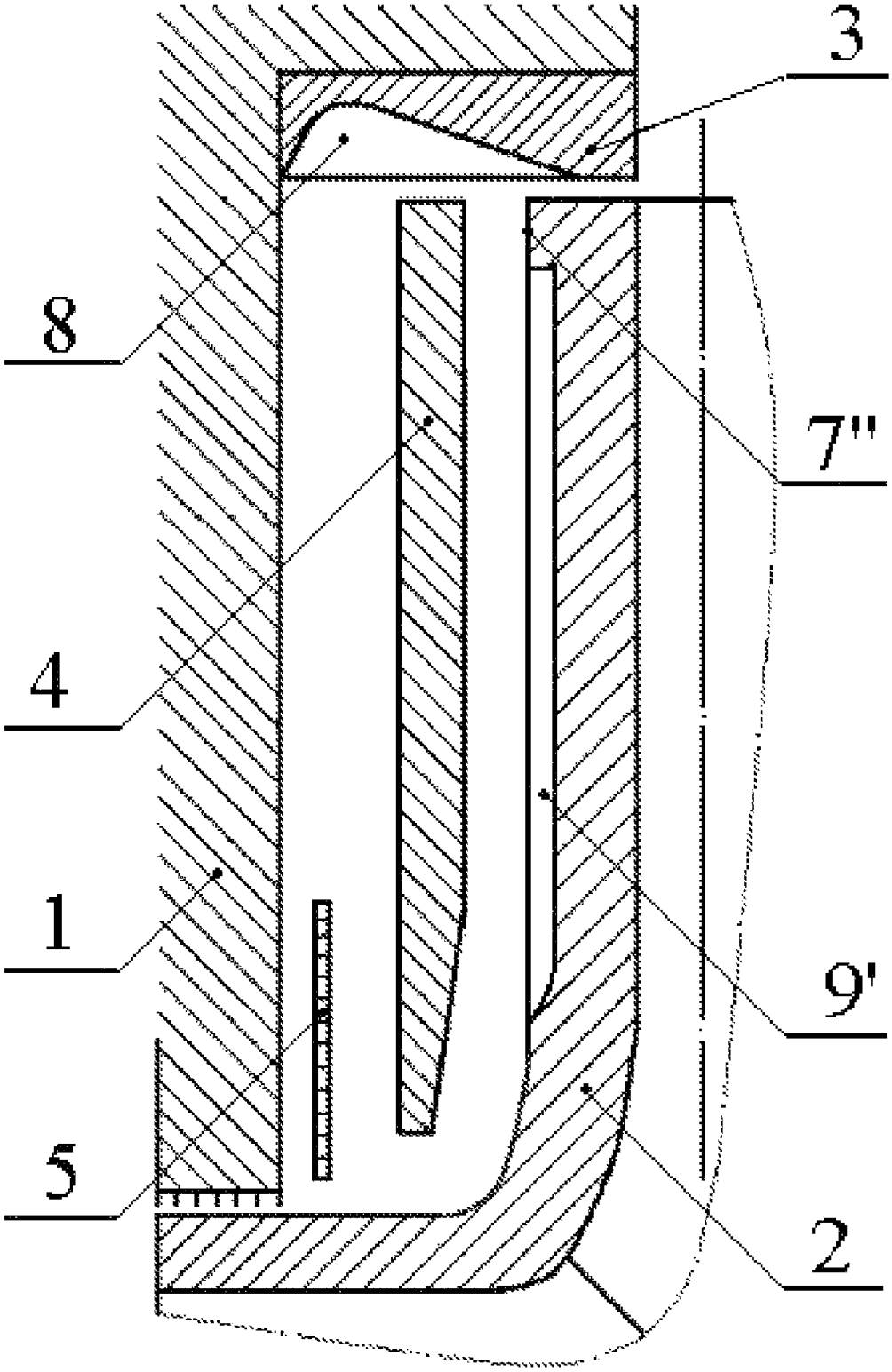
FIG. 3 is a cross-sectional view of a fragment of a rotary machine equipped with a device for reduction of axial thrust according to the third embodiment of the present invention.

Design Features of the Third Embodiment of the Invention as Shown on FIG. 3

Many design elements of FIG. 2 are incorporated into FIG. 3. The primary difference in FIG. 3 is that radial ribs such as spiral grooves (9') and restrictive means (7") are placed on the face of rotating rotor (2), not on stationary subdividing means (4). Such placement on the peripheral restrictive means on the rotating rotor is especially beneficial when the working fluid has low viscosity (such as gases or cryogenic liquids), and when additional performance is desired (increased thrust or increased fluid stiffness).

Figure 4:
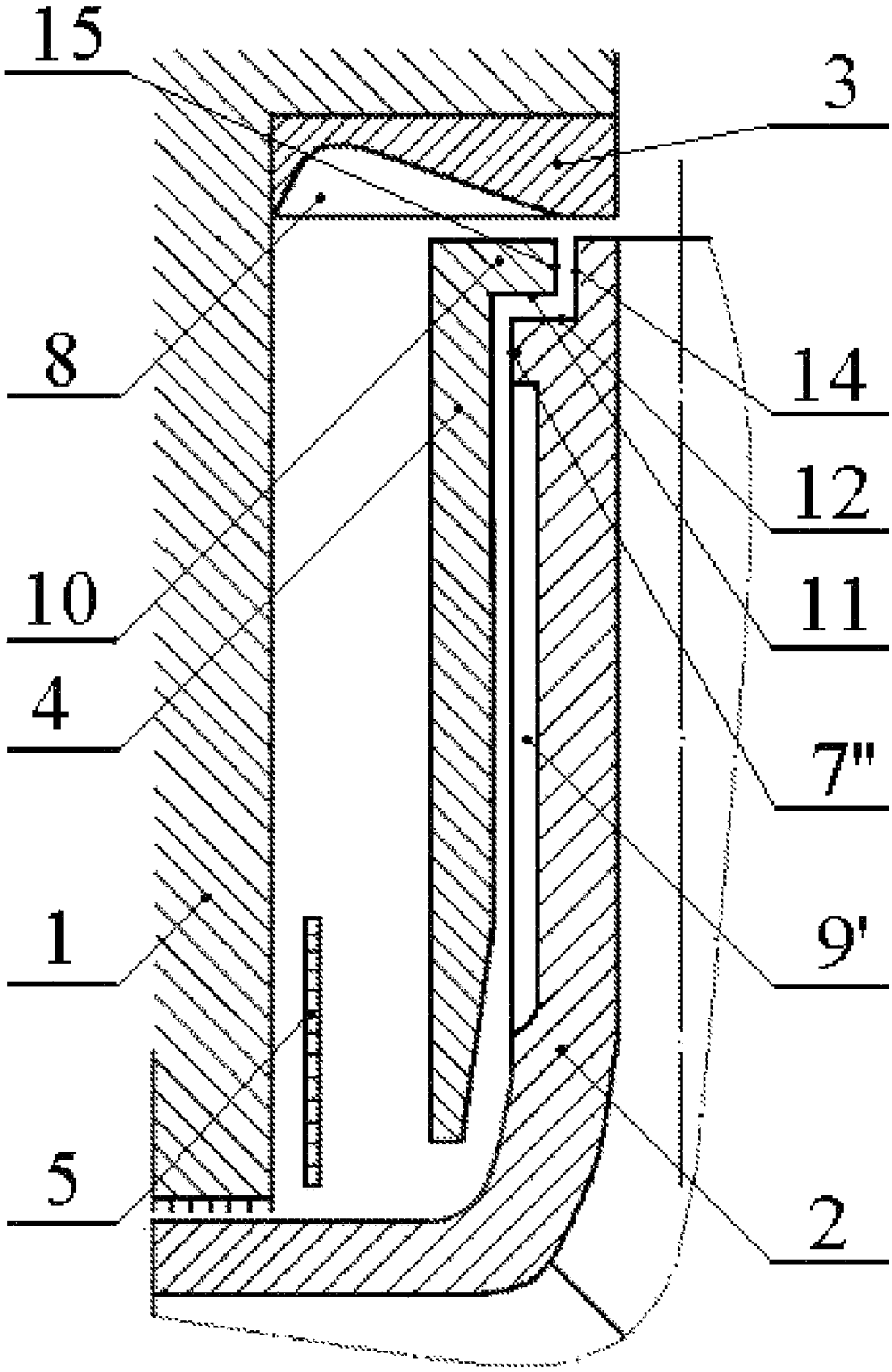
FIG. 4 is a cross-sectional view of a fragment of a rotary machine equipped with a device for reduction of axial thrust and for reduction of radial oscillations according to the fourth embodiment of the invention; and finally

Design Features of the Fourth Embodiment of the Invention as Shown on FIG. 4

Many design elements of FIG. 3 are incorporated into FIG. 4. The pumping radial ribs such as spiral grooves (9') and peripheral restrictive means (7") are placed on the front of the rotating rotor (2). At the perimeter of subdividing means (4), a ring piece (10) is formed/affixed, extending along the shaft of the rotary machine in parallel to the outer portion of the rotating rotor (2).

Two additional restrictive means areas are formed on the ring piece (10). A first (axial) restrictive means area is formed between an outer axial face (12) of the rotating rotor (2) and an opposing inner axial face (11) on the subdividing means (4), forming a self-pressurizing hydrodynamic radial journal bearing. A second (radial) restrictive means area is formed between an outer radial face (14) on rotating rotor (2) acting as another dam and an inner radial face 15 of the subdividing means (4), forming an axially-oriented self-pressurizing hydrodynamic thrust bearing. Preferably, to improve axial stiffness, the gap between the face (14) and it opposing face (15) is the same as (or near the same as) the gap between restrictive means (7") and its opposing face of the subdividing means (4). Preferably, to alter stiffness and damping characteristics, Rayleigh steps (or spiral or radial vanes, or wavy surface, etc.) are cut into the surfaces of restrictive means areas (11) and (15), or their opposing faces as described above. The peripheral surface of subdividing means (4) together with ring piece (10) can be flat (perpendicular to the main flow) as shown by the black line in the drawing, or an additional rounded protruding ring element as shown in the drawing can be formed to improve flow dynamics and to ensure that all of the flow enters the peripheral vanes (8).

In the system depicted on FIG. 4, residual axial thrust is designed to be biased in one direction, with resultant forces pushing the rotor (2) toward the shroud (1), such forces offset/balanced by the fluid-induced forces generated in the gap between the front of the rotor (2) and the subdividing means (4). The rotor performs like an element of a hydrostatic/hydrodynamic bearing. By virtue of its rotation, the rotor induces centrifugal pumping action (outward radial flow) of its adjacent fluid. Such outward radial flow component can optionally be increased by adding grooves or pumping elements on the rotating rotor. At the front edge of restrictive means (7"), such outward radial flow produces a high pressure annular region, with varying axial forces generated circumferentially depending on the size of its annular gap with subdividing means (4) (larger gap results in lower pressure in region, and visa versa), providing a self-adjusting system with automatic centering forces. An axially-oriented self-adjusting system is also produced, given that such high pressure region on restrictive means (7") and (14) increases non-linearly with a smaller gap from subdividing means (4). That results in an annular gap that automatically adjusts to develop sufficient localized pressure to offset/balance the level of residual axial thrust generated by the system. Therefore equilibrium conditions are formed within a narrow axial range as commonly found in hydrodynamic thrust bearings. Raleigh Steps or vanes cut into the stationary face of the axially oriented restrictive means areas (at (15) and opposing face of (7")) will reduce swirl (increasing stability/damping at this dam and at further downstream dams). Given the narrow clearances utilized in the present invention, abradable coatings may be beneficially employed to help (by rubbing during break-in period of the rotor) minimize negative effects caused by manufacturing imperfections, temperature effects or rotor growth (centrifugal growth or increase in dynamic orbit).

In this arrangement in FIG. 4, the axially oriented face (12) of the rotor (2) rotates inside the internal axially oriented face (11) of ring element (10). With rotor rotation and the resulting outward flow of fluid in the gap, this opposition of the faces forms a self-pressurized radial journal bearing. The pressure in the gap varies circumferentially (larger gap results in lower localized pressure, and visa versa) providing a self-adjusting system with automatic centering forces (hydrostatic/dynamic bearing effect). With increases in the eccentricity ratio, centering forces automatically increase in the high pressure region of the narrow gap area and with the corresponding pulling action from the high gap/low pressure region on the opposite end of the bearing. Preferably, the front to mid-region (in direction of flow) of stationary restrictive means element (11) has swirl brakes cut into its face, increasing the localized pressure to increase stiffness, and to improve stability (increases $\lambda$ to increase Threshold of Instability, as per Bently).

A number of benefits are gained using the proposed arrangement of self-pressurizing hydrodynamic bearing surfaces between the rotating rotor and the subdividing means (4). First, there is the addition of radial control components. There is the hydrostatic radial bearing at restrictive means (12) with opposing face (11), in effect acting as a radial bearing between the main bearings (at the ends of the shaft), thereby providing a means to significantly reduce the orbit of radial oscillations (radial deflections) and to improve radial damping. Another radial control component is added through the use of a conical annular gap between the front rotor (2) and the subdividing means (4), and given the large surface area of this annular gap and its narrowness, the magnitude of this radial component will be substantial. Given the large size/diameter of such radial bearing/rotor surface and the large volume of fluid pumped through the series of annular gaps and dams (the bearing system), and the resulting high stiffness and damping characteristics, such radial bearing capability will result in a significant increase in the first critical speed of the rotor. This is especially beneficial in centrifugal machines with multiple stages utilizing the radial bearing design features suggested in FIG. 4, resulting in a substantial increase in the Threshold of Instability ($\Omega$), improving safety and the reliability of the machine.

Second, due to the tortuous path taken by the fluid (a 90° redirection) to restrictive means (12), and then another 90% redirection to restrictive means (14), higher pressure is maintained further along the length of each dam surface (peripheral restrictive means), providing more restoring force (and stiffness) at each dam. Such tortuous path also increases the "squeeze effect" (producing higher pressure at each dam, especially radial dam (12), increasing fluid stiffness) occurring when the opposing surfaces are suddenly forced closer together, therefore protecting the opposing faces against direct contact. As described in an article by Wang (2003), *Mixed Lubrication of Coupled Journal-Thrust-Bearing Systems Including Mass Conserving Cavitation*, when a journal bearing and a thrust bearing are hydrodynamically coupled, an intensification of the hydrodynamic pressure exists in both bearings, with experimental tests indicating increases in load carrying capacity of 75% and 150% for the journal bearing and the thrust bearing, respectively. In addition, as is known in the art, a controlled eccentricity misalignment angle (non-coincident axis/center of shaft and bearing) improves the load carrying capacity of both the journal and thrust bearings. Wang reported that such effect has an even greater effect on the load carrying capability of the thrust bearing in a hydrodynamically coupled bearing system including that described in the present invention.

Third, the design shown in the Figures converts the rotating front rotor portion with subdividing means in the front cavity into a self-pressurizing axial-thrust bearing having high stiffness and damping characteristics, resulting in more-precise axial positioning (operates within a more narrow envelope) of the rotor. Using the subdividing means with peripheral vanes according to '507 patent, axial thrust can be reduced. The axial thrust does not increase as the eye seals wear off, so for the useful life of a machine residual axial thrust is within a relatively narrow range. That in turn allows minimizing the energy-draining hydrodynamic elements of the present invention (no need to design them to accommodate increased levels of thrust with worn seals). Particularly with the added axial stiffness provided by the self-pressurized bearing of the present invention, axial travel and vibration orbits will be further reduced.

Figure 5:
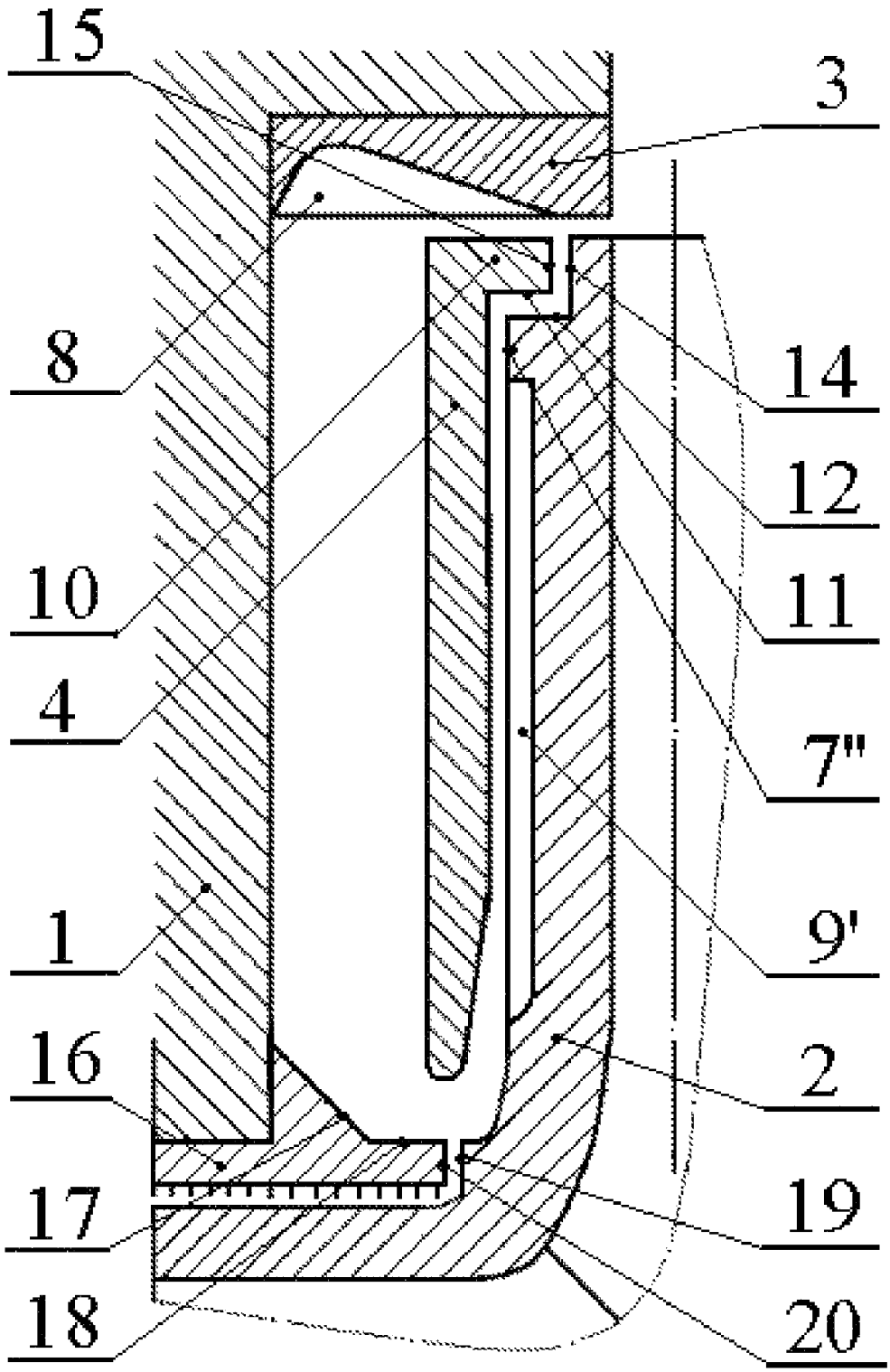
FIG. 5 is a cross-sectional view of a fragment of a rotary machine equipped with a device for reduction of axial thrust and for reduction of radial oscillations according to the fifth embodiment of the invention.

Design Features of the Fifth Embodiment of the Invention as Shown on FIG. 5

Many design elements of FIG. 4 are incorporated into FIG. 5. The primary difference is the addition of ring element 16 proximate the center region of the front cavity between the rotating impeller front shroud 2 and the casing 1. As shown, ring element 16 is formed as part of an element that comprises the interstage labyrinth eye seal between the casing 1 and the radially-oriented face of the rotating impeller, but it can be made optionally as a separate ring element with larger inner diameter.

One purpose of ring element 16 is to direct the returning flow (the second fluid flow, such flow between said subdividing means 4 and said casing 1 and moving toward the center), whereby such flow feeds the entrance to the annular space between rotating front shroud 2 and subdividing means 4. When such returning flow reaches the center region of the front cavity, it is deflected by diagonal face 17 and radial face 18 of ring element 16 and directed toward the annular space between rotating front shroud 2 and subdividing means 4. In effect, the peripheral vanes and annular space between the subdividing means 4 and casing 1, combined with ring element 16, function similar to a conventional interstage return channel of a multistage compressor/pump (but feeding the annular space between rotor shroud 2 and subdividing means 4 vs. feeding the main flow inlet to the impeller). Such diagonal face 17 and radial face 18 may be constructed as one element or as a combination of a number of elements, and may together be formed in other profile designs in efforts to alter flow characteristics, such as more-rounded contouring.

Preferably, a small annular gap is formed between end face 20 of ring element 16 and its opposing face 19 on the rotating impeller 2, functioning as a seal to inhibit leakage to suction. Such small annular gap acts in tandem with the existing eye seal (labyrinth, honeycomb, etc.), in effect forming the first stage of a (now) two-stage seal. Such seal faces are shown as flat annular faces at 90° to the rotating axis of the rotor, but other designs can also be implemented, such as 1) a curved/contoured surface that follows the contour of the existing design of its opposing face, the neck area of the impeller front shroud, 2) the faces at a different such angle to make the leakage path to suction more tortuous, and 3) other seal interface designs well known in the art, such as where one of the two faces is a labyrinth-, honeycomb-(, etc.) type seal, circumferential grooves, pump-out grooves or vanes opposing leakage flow, or where the two opposing faces follow each other in a step profile, similar to faces 7", 12 and 14 of the impeller shroud 2 with their opposing faces of the subdividing means, to provide a more tortuous path to impede leakage flow.

Although the present invention is described for a specific radial flow centrifugal pump or compressor, it is not limited thereto. Numerous variations and modifications would be readily appreciated by those skilled in the art and are intended to be included in the scope of the invention, which is restricted only by the following claims.

We claim:

1. A rotary machine with reduced axial thrust comprising:

a housing shroud with a center and a periphery, said housing shroud defining a fluid inlet and a fluid outlet, said housing shroud having at least one interior wall surface, a shaft rotatably mounted in said center of said housing shroud, a rotor mounted on said shaft, said rotor having at least one radial surface adjacent to said interior wall surface of said housing shroud, thereby defining a cavity therebetween, said cavity having a central area adjacent to the center of said shroud and a peripheral area adjacent to the periphery of said shroud, wherein rotating said rotor causing a fluid flow in said cavity, a flow subdividing means for separating said fluid flow into a first flow of said fluid between said flow subdividing means and said radial surface of the rotor and a second flow of said fluid between said flow subdividing means and said interior wall surface of the housing shroud, and a peripheral flow restrictive means to further alter said first flow of said fluid, said peripheral flow restrictive means formed and located between said subdividing means and said rotor in the peripheral area of said cavity, wherein axial position of said rotor defines a degree of restriction to said first flow by said peripheral flow restrictive means, whereby the fluid pressure in said rotary machine being altered to reduce the axial thrust on said rotor.

2. The rotary machine as in claim 1, wherein said flow subdividing means is a disk and said peripheral flow restrictive means is at least one sealing dam extending between said disk and said rotor.

3. The rotary machine as in claim 2, wherein said peripheral flow restrictive means defines a restricted gap for said first flow of said fluid to flow through, said gap being less than about 3 mm, whereby forming a hydrodynamic thrust bearing for said rotor.

4. The rotary machine as in claim 1, wherein said peripheral restrictive means extending from said subdividing means towards said rotor.

5. The rotary machine as in claim 4, wherein said subdividing means further comprising radial ribs to condition radial flow to improve lift in said rotary machine.

6. The rotary machine as in claim 5, wherein said radial ribs extending from said center towards said periphery to end in a vicinity but not overlap with said peripheral restrictive means.

7. The rotary machine as in claim 1, wherein said peripheral restrictive means extending from said rotor towards said subdividing means.

8. The rotary machine as in claim 1, wherein said rotor further comprising a plurality of radial ribs to condition radial flow so as to improve lift in said rotary machine.

9. The rotary machine as in claim 8, wherein said radial ribs extending from said center towards said periphery, said radial ribs extending towards but not overlapping with said peripheral restrictive means.

10. The rotary machine as in claim 1, wherein said subdividing means including an inner axial face, said rotor including an outer axial face, said outer axial face of said rotor located next to said inner axial face of said subdividing means forming an axial restrictive area therebetween, whereby a hydrodynamic radial journal bearing is formed between said subdividing means and said rotor.

11. The rotary machine as in claim 10, wherein said subdividing means including an inner radial face about its perimeter, said rotor including an outer radial face, said outer radial face of said rotor located next to said inner radial face of said subdividing means forming a radial restrictive area therebetween, whereby a hydrodynamic axial thrust bearing is formed between said subdividing means and said rotor.

12. The rotary machine as in claim 1, wherein a ring element is placed in said center, said ring element preferentially directing the second fluid flow to an annular space formed between said subdividing means and said rotor, whereby leakage to suction is reduced.

13. The rotary machine as in claim 12, wherein said ring element including a ring axial face, said rotor including a rotor axial face located adjacent to said ring axial face and forming an axial restrictive area therebetween, whereby a seal is formed between said ring element and said rotor.

14. A method to reduce axial thrust in a rotary machine, said machine including a housing shroud with a center and a periphery and an interior wall surface, said machine further including a rotor with a radial surface, said rotor rotatably mounted on a shaft supported in the center of said housing, said radial surface of the rotor being adjacent to said interior wall surface of the shroud thereby defining a cavity therebetween, said cavity having a central area proximate to the center of said housing shroud and a peripheral area proximate to the periphery of said housing shroud, said method including a step of subdividing a fluid flow in said cavity into a first flow of said fluid and a second flow of said fluid, said step therefore separating said first fluid flow from said second fluid flow, said method further including a step of additionally altering said first fluid flow in the peripheral area of said cavity.

15. The method as in claim 14, further including a step of forming a hydrodynamic radial journal bearing about said rotor, whereby reducing radial oscillations of said rotor.

16. The method as in claim 15, further including a step of forming an additional hydrodynamic thrust bearing next to said rotor.

* * * * *